United States Patent [19]

Jackson

[11] Patent Number: 4,914,258

[45] Date of Patent: Apr. 3, 1990

[54] UTILITY POLE HAVING AN ACCESS OPENING COVER OVER A RAISED PERIMETER ACCESS OPENING

[76] Inventor: Burt B. Jackson, Rte. 5, Box 475, Denham Springs, La. 70726

[21] Appl. No.: 270,622

[22] Filed: Nov. 14, 1988

[51] Int. Cl.[4] ..... F21S 1/10; H02G 7/20; B65D 45/00

[52] U.S. Cl. ..... 174/45 R; 138/92; 220/251; 362/431

[58] Field of Search ..... 174/38, 45 R, 66, 71 R; 138/92; 220/213, 243, 248, 250, 251, 325, 328; 285/121; 292/260; 362/431

[56] References Cited

U.S. PATENT DOCUMENTS

| | | | |
|---|---|---|---|
| 291,771 | 1/1884 | Rasgorshek | 138/92 X |
| 345,073 | 7/1886 | Phillips | 220/251 X |
| 1,846,400 | 2/1932 | Macfarlane | 220/251 |
| 2,422,420 | 6/1947 | Judd | 220/251 |
| 3,343,322 | 9/1967 | Lurkis et al. | 362/431 X |
| 3,755,977 | 9/1973 | Lewis | 138/92 X |

FOREIGN PATENT DOCUMENTS

| | | | |
|---|---|---|---|
| 289825 | 6/1965 | Netherlands | 362/431 |

*Primary Examiner*—Laramie E. Askin

*Attorney, Agent, or Firm*—William D. Kiesel; Robert C. Tucker; Timothy J. Monahan

[57] ABSTRACT

A cover for the access opening of utility poles is provided which has a shell dimensioned to overlie the opening. The shell has a flanged perimeter which conforms to the outside diameter of the pole. The shell is held in place by a bolt which extends through the shell and into the interior of the pole to engage a bar positioned within the pole, across the access opening. Preferably, the head of the bolt is seated within a recess in the shell to thwart unauthorized removal of the shell.

4 Claims, 1 Drawing Sheet

UTILITY POLE HAVING AN ACCESS OPENING COVER OVER A RAISED PERIMETER ACCESS OPENING

BACKGROUND OF THE INVENTION

1. Field of the Invention

This invention relates generally to a replacement cover for the access opening found near the base of aluminum utility poles and particularly to a universal replacement cover, suited to access openings of a variety of shapes and sizes.

2. Prior Art

Aluminum utility poles are cylindrical, hollow poles which are tapered at the top and provided with a flange at the base. A concrete foundation having a center conduit for electrical wires is provided for anchoring the base of the pole. The wires run up through the pole to a lighting fixture attached to the top.

An access opening is provided in the side wall of the pole for servicing the electrical wiring. The access openings come in a variety of shapes and dimensions. Typically, the openings are elliptically shaped and measure approximately 3 inches by 6 inches with the ends of the opening aligned vertically with the pole. The side edges of the access opening can be raised outward from the pole to present a flat surface which can be covered with a plate. Alternatively, the cover is curved to conform to the shape of the pole. Screws through the cover engage the pole thereby securing the cover.

The access opening covers have become the targets of increased attacks by vandals. The cover is either unscrewed or pried off exposing the electrical wires inside the pole. Once exposed, the wires may be cut or tampered with. The electrical wires present an attractive nuisance to neighborhood children who do not comprehend the danger of electricity.

Since the access openings and covers vary in size and shape, it is not always possible to locate the correct replacement cover. A large stock of replacement covers must be maintained. Unfortunately, the replacement covers themselves may succumb to repeat vandalism.

SUMMARY OF THE INVENTION

Therefore, one object of this invention is to provide a replacement cover for utility pole access covers which will fit a wide variety of access openings.

Another object of this invention is to provide an access opening cover which will deter future vandalism and protect internal electrical wiring from being tampered with.

Still another object of this invention is to provide an access cover which is both inexpensive to manufacture and easy to install.

Accordingly, a cover for a utility pole access opening is provided comprising a shell dimensioned to overlie the access opening, the shell having a perimeter edge corresponding to an outer cylindrical surface of the pole. The shell is attached to the pole by a bolt through the shell, which is connected to a bar placed inside the pole across the access opening.

PREFERRED EMBODIMENTS OF THE INVENTION

Figure 1:
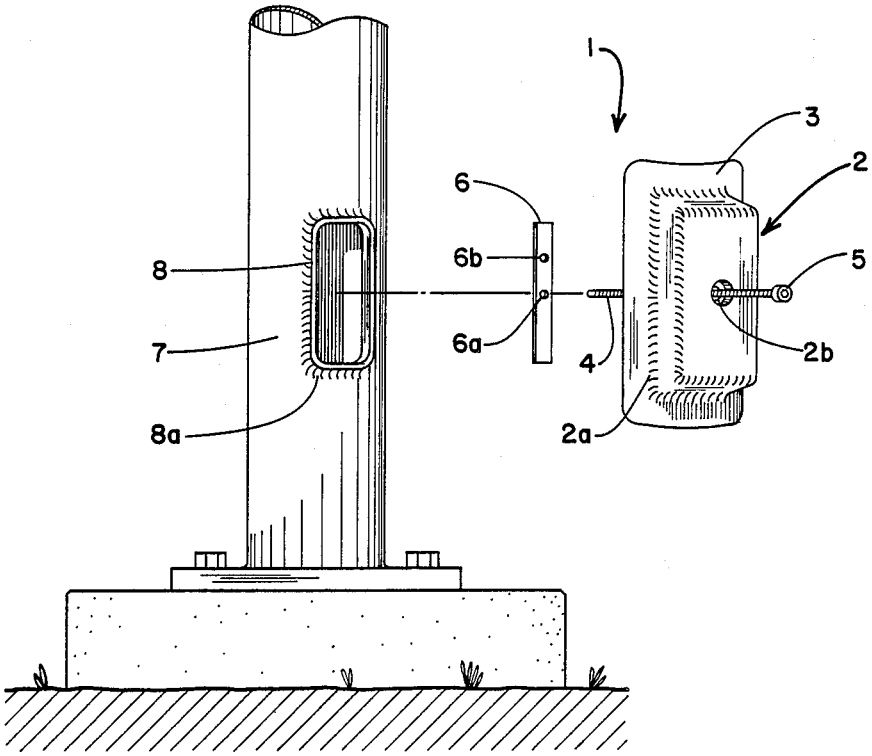
FIG. 1 is a perspective of the cover prior to being secured to a utility pole.

The universal cover is designed to replace the access cover plate of aluminum utility poles. Referring to FIG. 1, cover 1 is made up of shell 2 which has flange 3 connected to its perimeter 2*a*. Bolt 4 extends through opening 2*b* in shell 2. One end of bolt 4 has head 5 and an opposite end of bolt 4 is threaded to engage bar 6 at hole 6*a*.

Cover 1 is installed on pole 7 by first engaging bolt 4 and bar 6 and then inserting bar 6 into access opening 8. Once inserted through opening 8, bar 6 can be turned 90° by turning bolt 4. Bar 6 has a length greater than a distance across opening 8 so that when turned 90°, bar 6 is crossways across the inside of opening 8.

In FIG. 1, bar 6 is shown as being slightly shorter than the vertical, end to end distance of opening 8. It can be seen that bar 6 would be easily inserted into pole 7. In cases where the greatest distance across opening 8 is less than the length of bar 6, bar 6 must be inserted one end at a time. For example, as long as the distance across opening 8 is less than the length of bar 6 but greater than the distance from threaded hole 6*a* to an end of bar 6, bar 6 could be inserted one end at a time. If a smaller opening in pole 7 is encountered, bolt 4 could be threaded through hole 6*b* in bar 6. With bolt 4 through hole 6*b*, the longer end of bar 6 is inserted into opening 8 followed by the shorter end of bar 6. When the greatest distance across opening 8 is less than the length of bar 6, it may not be necessary to rotate bar 6 90° before tightening bolt 4.

The term "bar" is intended to include members which are jointed to fold in one direction for insertion into an opening and unfold to present a rigid bar when drawn in an opposite direction by a bolt.

Once bar 6 is in place inside pole 7, i.e. crossways across opening 8, bolt 4 can be tightened to draw shell 2 against the outside of pole 7. To maintain alignment of bar 6 during tightening, outward pressure is maintained on shell 2. In a preferred embodiment of cover 1, head 5 is an Allen head. Those with skill in the art will be able to adapt various other heads to bolt 4. In order to thwart vandals, a non-standard head is preferably used. For example, bolt heads which can be turned with screw drivers, pliers or hexagonal head wrenches are undesirable because of their susceptability to tampering. Conversely, bolt heads which require specialty wrenches or other tools are preferred. As discussed below, shell 2 may be recessed to protect head 5 of bolt 4.

Examples of suitable materials of construction of shell 2 and flange 3 are fiberglass or durable, shatter resistant plastic. The perimeter 2*a* of shell 2 and flange 3 are manufactured to correspond to the outside curvature of pole 7. In a preferred embodiment flange 3 is made of a flexible, resilient material and biased slightly inward. When cover 1 is secured tightly to pole 7, flange 3 is pressed against the outside of pole 7 to provide a close fit to help prevent vandals from easily prying off cover 1. Shell 2 and flange 3 may be produced in one piece from a suitable mold. In addition to injection molding plastic, or molding fiberglass, those with skill in the art may adapt other means to produce a unitary shell and flange.

Figure 3:
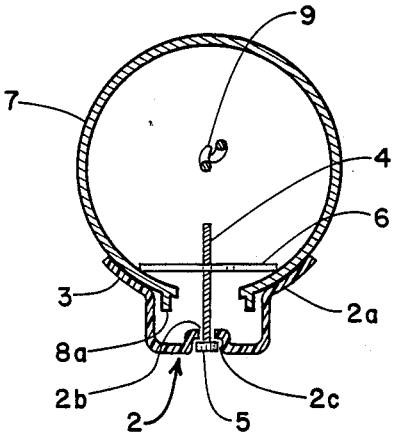
FIG. 3 is a cross section taken along line 3—3 of FIG. 2.

As shown in FIGS. 1 and 3, the perimeter 8*a* of access opening 8 may be raised from pole 7. Shell 2 must be deep enough to accommodate the raised perimeter 8*a* of opening 8 when flush against pole 7. Additionally, in a preferred embodiment, the perimeter 2*a* of shell 2 is greater than the perimeter 8*a* to fit flush against pole 7 providing a weatherproof seal.

Figure 2:
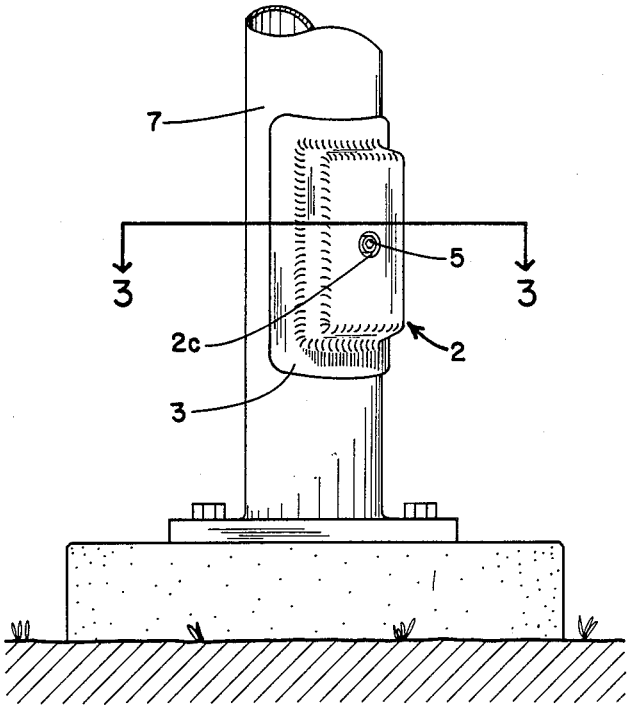
FIG. 2 is a perspective of the cover secured to the utility pole.

FIG. 2 shows shell 2 and flange 3 drawn tight against pole 7. FIG. 3 discloses the embodiment wherein shell 2 has recess 2*c* to shield head 5 of bolt 4.

FIG. 3 is a cross section taken along line 3—3 of FIG. 2. Bar 6 is crossways in opening 8 of pole 7. Shell 2 and flange 3 are tight against pole 7. Wires 9 can be seen running the length of pole 7.

There are, of course, many alternate embodiments and modifications of the invention disclosed herein which are intended to be included within the scope of the following claims.

What I claim is:

1. In combination with a utility pole having an access opening with a raised perimeter, an access opening cover comprising:

(a) a shell overlying said raised perimeter of said access opening, said shell having a perimeter surrounding said raised perimeter of said access opening, said perimeter of said shell corresponding to an outer curvature of said utility pole, said shell having sufficient depth to contact said outer curvature of said utility pole when overlying said access opening;

(b) a bar positioned inside said utility pole across said access opening, the length of said bar being greater than a distance across said access opening; and (c) means engaging said shell and said bar.

2. The combination according to claim 1, wherein said engaging means comprises a bolt through said shell having an end with a head pressed against the outside of said shell, and an opposite end threaded through a hole in said bar.

3. The combination according to claim 2, comprising a flange extending outward from said perimeter of said shell, said flange corresponding to and being in contact with said outer curvature of said utility pole.

4. The combination according to claim 3, wherein said flange is flexible and is biased inward towards said utility pole.

* * * * *